United States Patent [19]

Lalley

[11] 3,941,385

[45] Mar. 2, 1976

[54] GAME

[76] Inventor: John J. Lalley, 465 E. Washington St., Ionia, Mich. 48846

[22] Filed: June 25, 1974

[21] Appl. No.: 483,029

Related U.S. Application Data

[63] Continuation of Ser. No. 278,575, Aug. 7, 1972, abandoned.

[52] U.S. Cl. ..... 273/131 BB

[51] Int. Cl.[2] ..... A63F 3/04

[58] Field of Search ..... 273/131, 137 R

[56] References Cited

UNITED STATES PATENTS

| | | | |
|---|---|---|---|
| 815,960 | 3/1906 | Kuhn | 273/131 K |
| 1,160,348 | 11/1915 | Watkins | 273/131 BB |
| 1,165,688 | 12/1915 | Maris | 273/131 AB |
| 1,265,085 | 5/1918 | Ishida | 273/131 B |
| 1,281,040 | 10/1918 | McNeight | 273/131 AB |
| 1,579,327 | 4/1926 | Knowles | 273/131 BB X |
| 1,666,953 | 4/1928 | Tuttle et al. | 273/131 BB |
| 1,771,507 | 7/1930 | Naumann | 273/131 K |

FOREIGN PATENTS OR APPLICATIONS

| | | | |
|---|---|---|---|
| 694,081 | 9/1930 | France | 273/137 R |
| 27,449 | 11/1909 | United Kingdom | 273/131 B |
| 10,729 | 5/1911 | United Kingdom | 273/131 B |
| 1,141,463 | 1/1969 | United Kingdom | 273/131 BB |

*Primary Examiner*—Paul E. Shapiro

*Attorney, Agent, or Firm*—Harness, Dickey & Pierce

[57] ABSTRACT

A novel game apparatus and method of play which includes a game board and a number of pawns or player elements, certain of which are representative of forces of good and others of which are representative of forces of evil and which are selectively movable along or over the game board in order to achieve a predetermined game objective.

7 Claims, 3 Drawing Figures

FIG. 1.

GAME

This is a continuation of application Ser. No. 278,575, filed Aug. 7, 1972, now abandoned.

SUMMARY OF THE INVENTION

Generally speaking, the present invention relates to a method and apparatus for playing a game which includes a game board representative of a real or imaginary geographical area. As little as two and as many as 57 different players can play the game by manipulating a plurality of pawns or player elements upon the board. The pawns consist of a first plurality of pawns which are representative of forces of good and a second plurality of pawns which are representative of forces of evil. The game board has depicted thereon a map of a geographical area which is typically divided into "east" and "west" sections lying on the opposite sides of a geographical boundary, such as a river or other dividing indicia. The various pawns are given certain numerical powers ranging from 0 through 10. The power of each respective pawn is imprinted directly on the pawn and when the various pawns are placed upon the game board or map, the indicia indicating the power of the pawn faces toward the player or players who are in control of such pawns, with the result that the opposing player cannot observe and hence does not know the specific power of each of the pawns of the opposite player. The "evil" pawns are initially placed on one side of the boundary and the "good" pawns are initially placed on the opposite side of the river.

The actual playing of the game consists of alternate players (in the case of two separate persons playing the game) taking alternate turns, with each turn consisting of moving one of his respective pawns in a predetermined manner. During each turn, any one pawn can be moved in a straight line in any direction one or two spaces or sections which are defined by a gridwork on the game board. No one pawn may jump over another pawn which is lying along its path of movement and certain of the pawns may move in a predetermined direction any amount of spaces. In addition, as the respective pawns move to certain geographical areas depicted on the map of the game board, these pawns may move only one space per turn. For example, the pawns may move only one space per turn as they move through or across rivers, mountains and certain forested areas of the map.

When pawns of opposing forces (players) occupy spaces that are directly adjacent one another or are obtainable from their respective positions during a player's turn, an encounter of the two respective pawns can be made. Such encounters occur simply by one player taking his pawn and knocking over the opposing pawn with the encountering pawn. When an encounter is made, the player making the encounter calls out the pawn's name or the power of his pawn and the pawn with the lesser power is removed or eliminated from the game. In the event pawns of like power or value encounter one another, the pawn striking first is to be considered the more powerful one. Certain of the pawns have the characteristic that they cannot eliminate an opposing pawn; however, they have the ability to "trap" an opposing pawn upon an encounter occurring therebetween. When a pawn is trapped by such an opposing pawn, the trapped pawn cannot make any further moves until such time as it is released by a pawn that has the power to release it (either good or evil) and this occurs at such time as another pawn encounters the trapping pawn of the opposing side. Underlying the various moves by the pawns of the respective forces of good and evil is the object of moving certain of the pawns to a predetermined geographical location on the game board and the object of the opposing pawns to prevent such movement. The various movements of these pawns, along with various additional game objectives, will become apparent with the following detailed description.

It is accordingly a general object of the present invention to provide a new and improved game which includes a game board and a plurality of pawns or player elements which are adapted to be alternately moved by opposing players.

It is another object of the present invention to provide a new and improved game wherein as little as two and as many as in excess of fifty players can play.

It is still another object of the present invention to provide a new and improved game of the above character which is extremely easy to understand and easy to play.

Other objects and advantages of the present invention will become apparent from the following detailed description taken in connection with the accompanying drawing.

DETAILED DESCRIPTION OF THE PREFERRED EMBODIMENT

Figure 1:
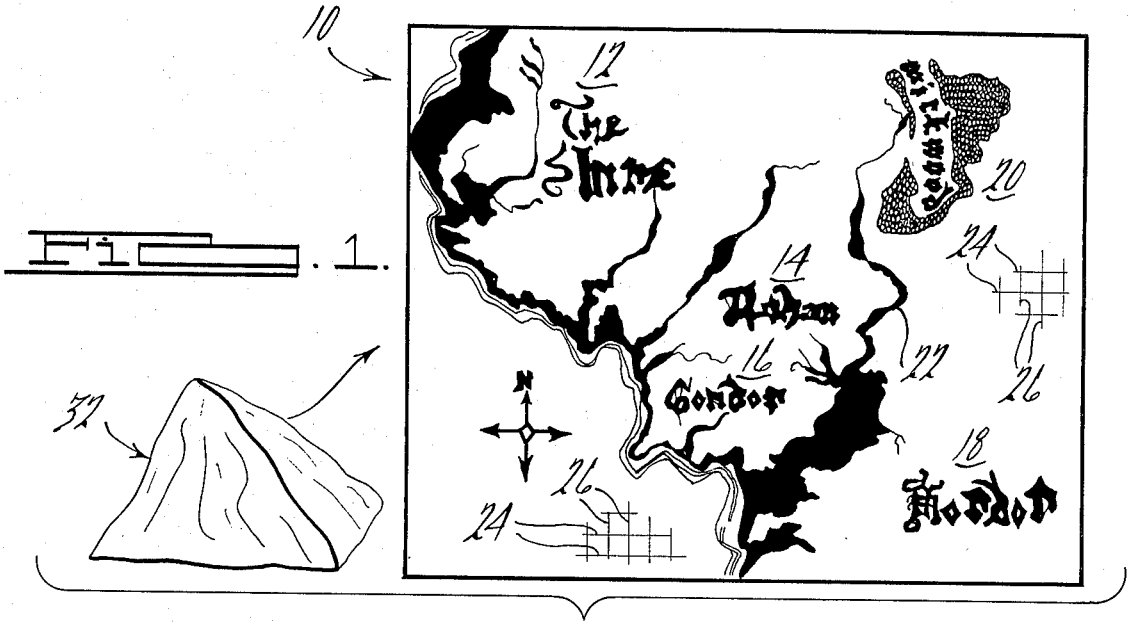
FIG. 1 illustrates a game board which is embodied in the present invention.

Referring now in detail to the apparatus of the novel game of the present invention, as best shown in FIG. 1, such apparatus includes a game board or playing area representatively designated by a numeral 10 and which may consist of a printed section of cardboard, cloth, leather or other structural material having a geographical map depicted thereon. The map on the game board 10 includes a first geographical area 12 which is representatively designated by the name "The Shire" and which is provided with a plurality of adjacent areas 14, 16 and 18 that are respectively given the names of Rohan, Gondor and Mordor. A second geographical area, representatively designated as "The Forest of Mirkwood" or the "Mirkwood Forest" is depicted on the board 10 and is designated by the numeral 20. The map is provided with a river or other boundary type indicia designated by the numeral 22 and entitled, for purposes of this disclosure, the Anduin River. A grid consisting of a series of horizontal and vertical lines 24 and 26 are equally spaced upon the map of the game board 10 and define a plurality of spaces upon which the player pawns are to be situated, in a manner hereinafter to be described. It will be noted that the lines 24, 26 define a plurality of square spaces in the game board shown in FIG. 1; however, the present invention is in no way to be limited to this configuration since the pawn areas may consist of parallelograms, triangles or other polygonal areas of uniform or differing sizes.

Generally speaking, the player elements or pawns, hereinafter to be described in detail, are divided into two groups, with a first plurality of pawns being representative of forces of good (or some other real or imaginary group) and a second plurality of pawns being representative of forces of evil. The basic playing field defined by the game board 10 is intended to be divided into two essential areas, namely the area on the left or west side of the game board 10 and the area on the right or east side of the game board 10. The two areas are divided by some imaginary or real boundary which, in the present application, consists of the Anduin River 22. It will be appreciated, of course, that the present invention is not intended to be limited to the specific configuration shown in FIG. 1 since various geographical or other areas could be depicted thereon and the boundary between the two opposing areas upon which the player elements or pawns are initially situated could be provided by any one of a number of different dividing or boundary structures, such as an imaginary wall, forest, or the like.

Figure 2:
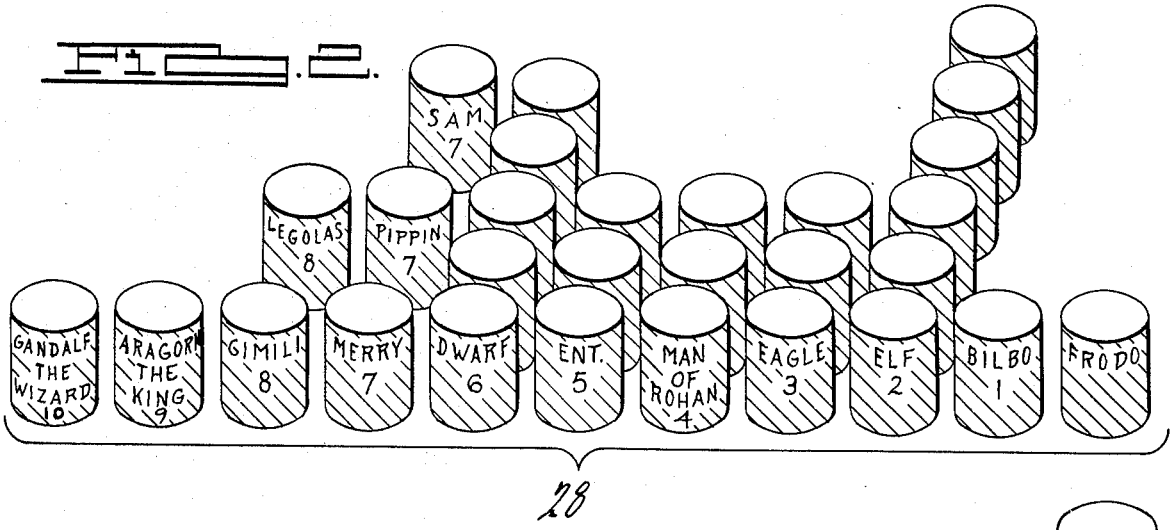
FIG. 2 is a schematic representation of a first plurality of player elements or pawns which are used in connection with the game of the present invention.
Figure 3:
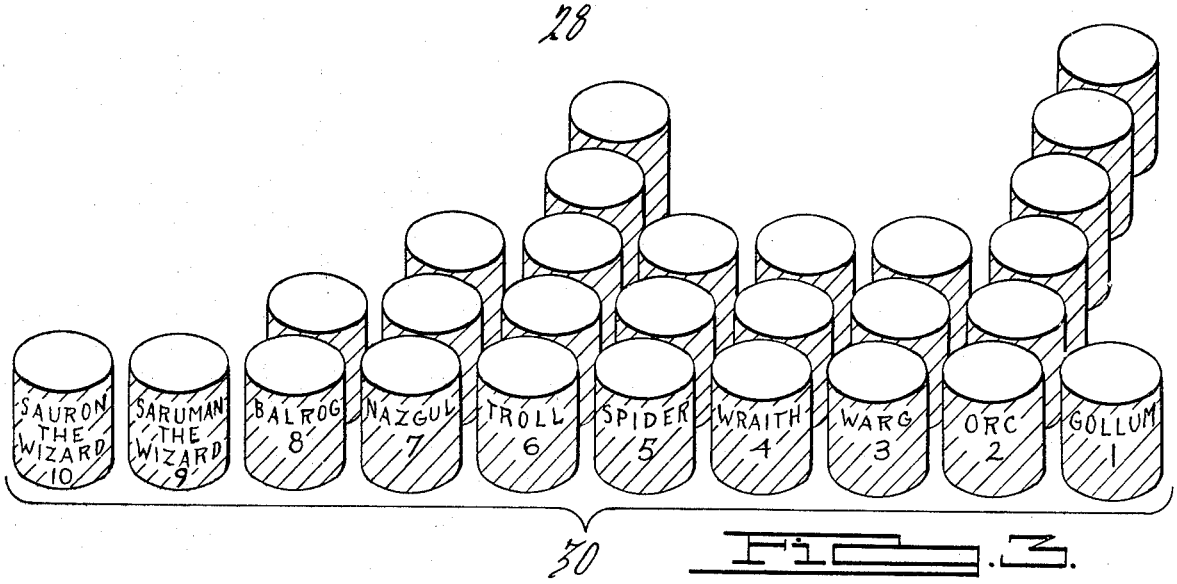
FIG. 3 is a schematic representation of a second plurality of player elements or pawns which are to be used in connection with the game of the present invention.
Figure 1:
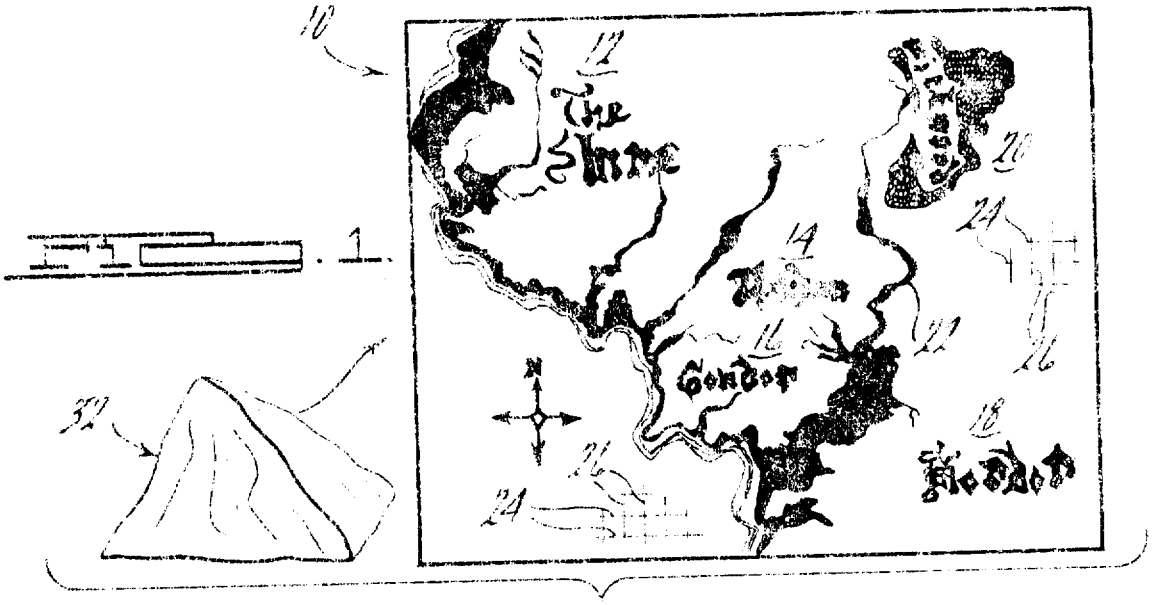
Figure 2:
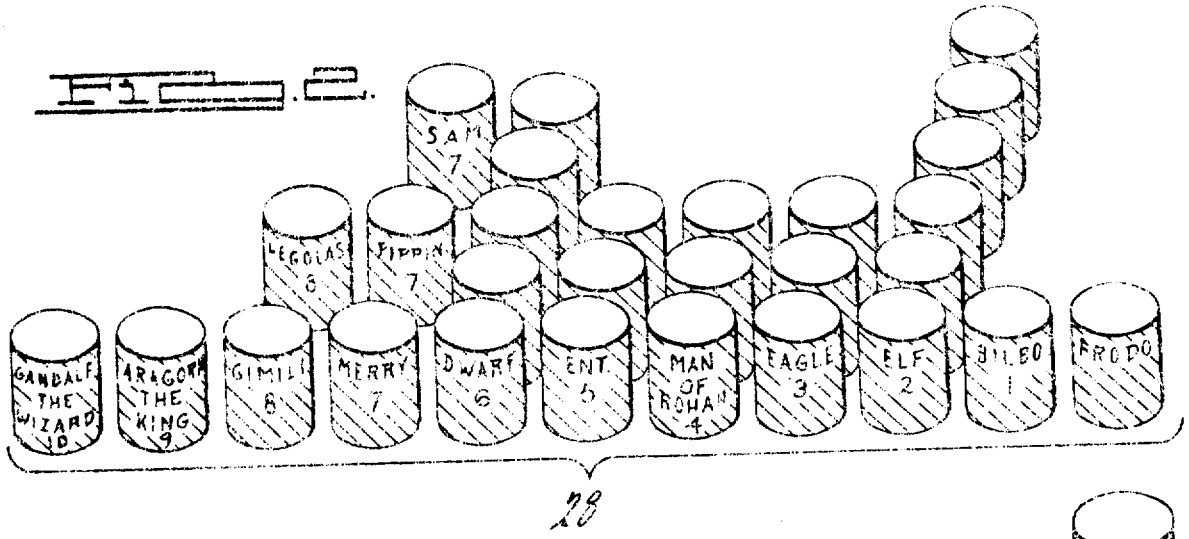
Figure 3:
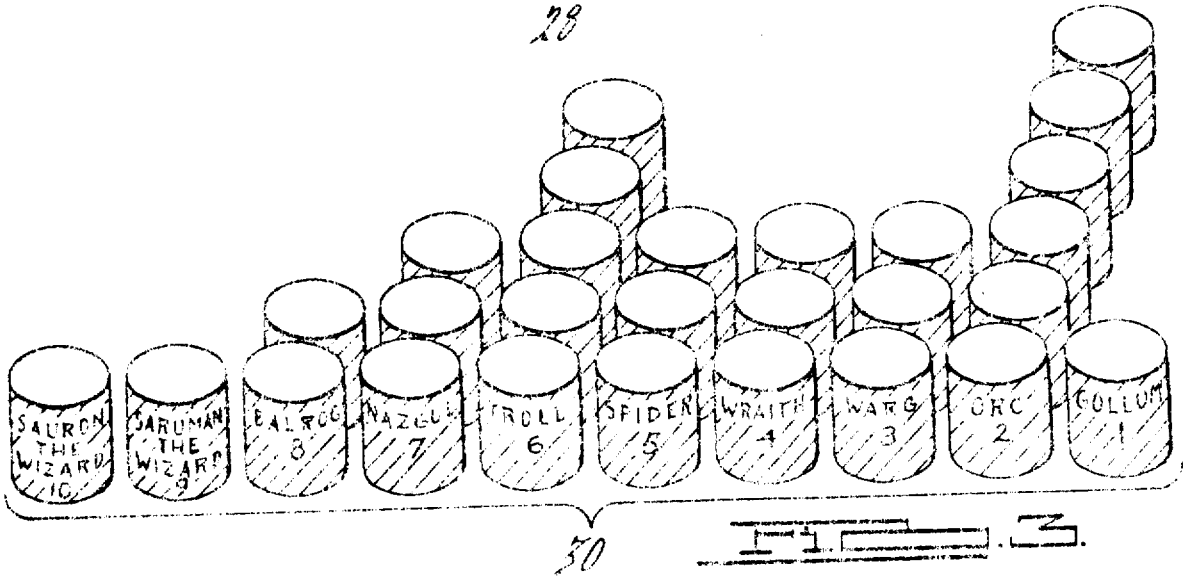

Referring now in detail to the player elements or pawns, as best seen in FIGS. 2 and 3, the pawns consist of three-dimensional members which may be fabricated, for example, of wood, stone, or other natural or synthetic materials. These pawns may typically be the size suitable for convenient movement upon the game board 10 and are representatively shown as being circular-cylindrical in shape, although various other sizes and shapes will be found to be satisfactory for purposes of playing the game of the present invention. Generally speaking, the plurality of player elements or pawns consists of a first plurality of pawns, generally designated by the numeral 28, which are representative of good and which may be played by one or a first group of players, and a second plurality of pawns, generally designated by the numeral 30, which are representative of evil and may be played by a second player or group of players. The first and second pluralities of pawns 28 and 30, respectively, consist of a multiplicity of pawns which have indicia placed thereon indicating the power or ranking of the respective pawns ranging from 0 to 10. In addition, the indicia on the respective pawns may include the name of the various pawns, which names are hereinafter given merely for purposes of example.

In accordance with one preferred form of the present invention, the first plurality of pawns 28, representative of good, consists of one pawn having a power of at least 10 and entitled Gandalf the Wizard; one pawn having a power of at least 9 and entitled Aragorn the King; two pawns having a power of at least 8 and entitled Gimili and Legolas; three pawns having a power of at least 7 and entitled Merry, Pippin and Sam; five pawns having a power of at least 6 and all given the name Dwarf; three pawns having a power of at least 5 and entitled Ents; three pawns having a power of at least 4 and entitled Men of Rohan; three pawns having a power of at least 3 and entitled Eagles; six pawns each having a power of at least 2 and entitled Elves; one pawn having a power of at least 1 and entitled Bilbo and one pawn having a power of 0 and entitled Frodo. The second plurality of pawns, generally designated by the numeral 30, consists of one pawn having a power of at least 10 and entitled Sauron the Wizard; one pawn having a power of at least 9 and entitled Saruman the Wizard; two pawns having a power of at least 8 and entitled Balrog; three pawns having a power of at least 7 and entitled Nazgul; five pawns having a power of at least 6 and entitled Trolls; three pawns having a power of at least 5 and entitled Spiders; three pawns having a power of at least 4 and entitled Wraith; three pawns having a power of at least 3 and entitled Wargs; six pawns having a power of at least 2 and entitled Orcs; and one pawn having a power of at least 1 and entitled Gollum.

In addition to the above apparatus, as best seen in FIG. 1, the game board 10 is provided with an additional apparatus in a form of a marker element 32 which is in the form of a stone intended to be representative of a mountain, which element 32 is entitled "The Mountain of Doom" and is intended to function in a manner hereinafter to be described.

For purposes of identification, each person playing the game is termed a "player" and "the player" is a person who is taking his turn at a particular point in the game. Additionally, a player may consist of a single individual or a group of individuals and accordingly, a minimum of two players can play the game and as many players can play the game as there are pawns; however, for purposes of simplicity of disclosure, the game of the present invention will now be described as it would be played with two players, one of which is representative of good and is in control, i.e., is adapted to move, the first plurality of pawns 28, and a second player which is representative of evil and is in control of the second plurality of pawns 30. Preparatory to initiating an actual game, the Mountain of Doom 32 is selectively placed on the game board 10, for example, somewhere in the Mordor 18. Thereafter, each of the two players is assigned one of the plurality of pawns 28 and 30. The players take their respective pluralities of pawns 28 and place them one on each of any of the pawn positions 24 located on the opposite sides of an imaginary boundary separating the east side of the map on the game board 10 from the west side of the map. This imaginary boundary for purposes of illustration, consists of the Anduin River 22, as previously described. In a preferred playing of the present invention, the first plurality of pawns 28, representative of good, are placed east of the Anduin River, while the second plurality of pawns 30 are placed west of the river 22. The various pawns may be located in any desired manner, provided, however, that each pawn is placed on a separate pawn position 24. The various pawns 28, 30 are oriented on the game board 10 such that the player who is in control thereof can observe the indicia, i.e., name and power, of his respective pawns and such that the opposing player cannot see such indicia. Thus, the indicia on the pawns 28 will face to the left side of the game board 10 as depicted in FIG. 1, while the indicia on the plurality of pawns 30 will face the right side of the game board 10, as shown in FIG. 1. Once the pawns have been thus positioned, no further movement can be made until the game is initiated.

The game is initiated by the player who is in control of the forces of good, i.e., the first plurality of pawns 28, making a first move. Thereafter, the players will alternate turns, with the next turn being taken by the player representative of the forces of evil, the following move by the player representative of the forces of good, etc.

A "move," as defined herein, consists of a player taking one of his pawns and actually repositioning it on some other pawn position on the board 10. The pawns can move in a straight line, in any direction, one or two spaces, i.e., pawn positions, during each turn. In addition, the Wizards, Elves, Orcs, Gollum and Frodo may move as many spaces in a straight line as desired each turn. No pawn may jump over another pawn. In addition, all pawns may move only one space per turn as they are moving through or across a river, mountain, or forest, or any other predetermined geographical location on the game board 10.

At such time as two pawns of opposing forces, i.e., of the different pawn pluralities 28 and 30, occupy pawn positions that are directly adjacent to one another, an encounter can be made. It will be noted, however, that simply because pawns of different forces occupy such adjacent spaces, an encounter need not occur. An "encounter" is defined as one player during his turn, moving a selected pawn onto the adjacent pawn position which is occupied by the pawn of the opposing player, whereby the occupied pawn is caused to be knocked down or to fall over. At the same time, the player who is moving his pawn calls out the name of his encountering pawn. As the encounter occurs, the opposing pawn is revealed, i.e., the power of a pawn which has been encountered, is disclosed. The pawn with the greater power is considered to be superior to that of a pawn of lesser power, and the less powerful pawn must then be removed from the game. In the event pawns of like value or power are encountered, the pawn striking first is considered to be the more powerful.

The pawns which are entitled Ents and Spiders having the power of 5 are considered special pawns in that when they are confronted during an encountering procedure, they cannot cause the opposing pawn to be eliminated; however, they do have the power to trap the opposing pawn. Thus, when an opposing pawn is encountered by either an Ent or a Spider, the Ent or Spider "traps" the opposing pawn and thereby prevents the opposing pawn from making any further movements during subsequent turns. The pawns which are entitled Trolls and Dwarfs having a power of 6 are the only pawns which have the power to cause a "trapped" pawn to be released from an Ent or a Spider. In order to effect such a release, the Troll or Dwarf, depending on whether or not an Ent or a Spider has caused an opposing pawn to be trapped, is moved so as to effect an encounter with the Ent or Spider. When such an encounter does occur, the Ent or Spider which has performed the trapping of the opposing pawn is eliminated, thus freeing the trapped pawn so that he can be moved during subsequent moves.

Referring to pawns which have particular power, namely, Gimili which is a Dwarf and functions as other Dwarfs function, i.e., in removing Spiders; the Gimili pawn has a power of 8 and thus gives him a greater encountering power. In addition, Legolas, which is an Elf pawn and can move as other Elves move, i.e., as many spaces in one direction as possible; however, Legolas has a power of 8 and thus he has a greater power than the remaining of the Elves which only have a power of 2.

The general object of the game is three-fold; the first object is for the player representative of the power of good, i.e., the player who is in charge of the first plurality of pawns 28, to move Frodo, who has the power of 0, to the Mountain of Doom, wherever the member 32 has been placed during a particular game. The reason for this is that Frodo is in possession of an imaginary ring which must be destroyed, and this destruction can only occur at the Mountain of Doom. The second objective is that the player or players in control of the force of evil, i.e., the plurality of pawns 30, is to find Frodo and return him to the Mountain of Doom; the final object of the game is for Gollum to find Frodo and cause an encounter to be made therewith, thereby ending the game.

It is to be noted that the present invention is not limited to the specific method and apparatus hereinabove described since varying numbers of pawns having different powers may be utilized without departing from the scope of the present invention. In addition, the present invention is not intended to be limited to the pawns having the names hereinabove described which have been presented merely for purposes of example. Also, the present invention is in no way to be limited to the specific geographical depiction on the game board 10, since various other geographical areas could be depicted, which geographical locations could be fictional or non-fictional, real or imaginary, as desired. It is also contemplated that the present invention could occur, not on a game board, but on an actual area of ground wherein the various pawns would be represented by individual persons having indicia in the form or a card or placard located on their back, with the encountering occurring between individual persons and resulting in the elimination of these people by the persons having a placard indicating a greater power. Of course, various other related apparatus and methods are intended to come within the scope of the present invention, as defined by the appended claims.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. In combination, a game apparatus consisting of:

a game board having means depicting a geographical area including first and second irregular, non-symmetrical, non-mirror image geographical sections and means defining a boundary between said sections, means defining a plurality of generally uniformly distributed pawn positions on said geographical area, a predetermined number of pawns located on said pawn positions, said predetermined number of pawns consisting of a first plurality of pawns each having indicia means on the side walls thereof representative of a power of between 1 and 10 and oriented on selected pawn positions on said first geographical section such that said indicia faces away from said second geographical area, a second plurality of pawns equal in number to said first plurality with each having indicia means on the side walls thereof representative of a power of between 1 and 10 and oriented on selective pawn positions on said second geographical section such that said indicia faces away from said first geographical section, and a pawn having an indicia of 0 located on one of said first and second geographical sections, and a movable marker located on the other of said geographical sections and defining an objective piece for said last mentioned pawn.

2. The invention as set forth in claim 1 wherein at least one of said pawns has the power to trap other of said pawns so as to prevent further movement of the trapped pawn from one of said pawn positions to another thereof, and wherein at least one of said pawns is capable of effecting release of said trapped pawn.

3. The invention as set forth in claim 1 wherein said first plurality of pawns comprises twenty-eight pawns having the following powers: one pawn having a power of 10, one pawn having a power of 9, two pawns each having a power of 8, three pawns each having a power of 7, five pawns each having a power of 6, three pawns each having a power of 5, three pawns each having a power of 4, three pawns each having a power of 3, six pawns each having a power of 2, and one pawn having a power of 1.

4. The invention as set forth in claim 3 wherein said pawn having a power of 10 is Gandalf the Wizard, wherein said pawn having a power of 9 is Aragorn the King, wherein said pawns having a power of 8 are Gimili the Dwarf and Legolas the Elf, wherein said pawns having a power of 7 are The Hobbitts, Merry, Pippin and Sam, wherein said pawns having a power of 6 are the five Dwarfs, wherein said pawns having a power of 5 are Ents and the two Walking Trees, wherein said pawns having a power of 4 are the three Men of Rohan, wherein said pawns having a power of 3 are the three Eagles, wherein said pawns having a power of 2 are the six Elves, wherein said pawn having a power of 1 is Bilbo the Hobbit.

5. The invention as set forth in claim 3 wherein said pawn having a power of at least 10 is Sauron the Wizard, wherein said pawn having a power of at least 9 is Saruman the Wizard, wherein said pawns having a power of at least 8 are the Balrogs, wherein said pawns having a power of at least 7 are the Nazguls, wherein said pawns having a power of at least 6 are the Trolls, wherein said pawns having a power of at least 5 are the Spiders, wherein said pawns having a power of at least 4 are the Wraiths, wherein said pawns having a power of at least 3 are the Wargs, wherein said pawns having a power of at least 2 are the Orcs and wherein said pawn having a power of at least 1 is Gollum.

6. The invention as set forth in claim 1 wherein said second plurality of pawns comprises twenty-eight pawns having the following powers: one pawn having a power of 10, one pawn having a power of 9, two pawns each having a power of 8, three pawns each having a power of 7, five pawns each having a power of 6, three pawns each having a power of 5, three pawns each having a power of 4, three pawns each having a power of 3, six pawns each having a power of 2 and one pawn having a power of 1.

7. The invention as set forth in claim 1 wherein said pawn having an indicia of 0 comprises Frodo the Ringbearer.

* * * * *

UNITED STATES PATENT OFFICE

CERTIFICATE OF CORRECTION

Patent No. 3,941,385 Dated March 2, 1976

Inventor(s) John J. Lalley

It is certified that error appears in the above-identified patent and that said Letters Patent are hereby corrected as shown below:

Cancel the sheet of drawing as shown and substitute the attached sheet.

Signed and Sealed this

Fourteenth Day of September 1976

[SEAL]

*Attest:*

RUTH C. MASON
*Attesting Officer*

C. MARSHALL DANN
*Commissioner of Patents and Trademarks*